United States Patent [19]

Pfahl

[11] 4,029,038

[45] June 14, 1977

[54] RELEASABLE RUDDER LOCK

[76] Inventor: Kurt J. Pfahl, 3077 Hayes Ave., Costa Mesa, Calif. 92626

[22] Filed: Dec. 22, 1975

[21] Appl. No.: 642,908

[52] U.S. Cl. ..... 114/162; 114/165; 248/221.3

[51] Int. Cl.[2] ..... B63H 25/06

[58] Field of Search ..... 114/162, 165, 169, 172; 292/87; 179/96; 24/217; 248/224, 289 R

[56] References Cited

UNITED STATES PATENTS

| | | | |
|---|---|---|---|
| 2,151,284 | 3/1939 | Tinnerman | 24/217 |
| 2,178,555 | 11/1939 | Briggs | 114/162 |
| 3,854,434 | 12/1974 | Pfahl | 114/172 |

*Primary Examiner*—Trygve M. Blix

*Assistant Examiner*—Sherman D. Basinger

*Attorney, Agent, or Firm*—Gordon L. Peterson

[57] ABSTRACT

A rudder lock for pivotally mounting a rudder on a boat and comprising a bracket attachable to the rudder, a pintle attached to the bracket, and a mounting member attachable to the boat and having an aperture sized to receive the pintle. A resilient lock element is carried by the mounting member and engageable with the pintle when the pintle is received in the aperture of the mounting member. Cooperating surfaces on the resilient lock element and the pintle retain the pintle against withdrawal from the aperture of the mounting member. The resilient lock element is resiliently movable to allow withdrawal of the pintle from the aperture.

8 Claims, 4 Drawing Figures

Fig. 1
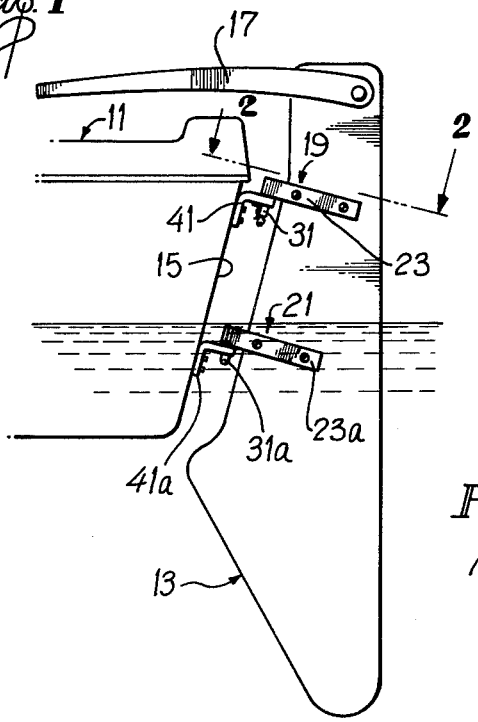
Fig. 3
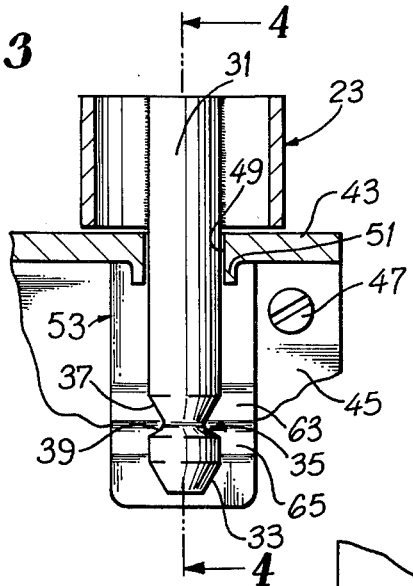
Fig. 4
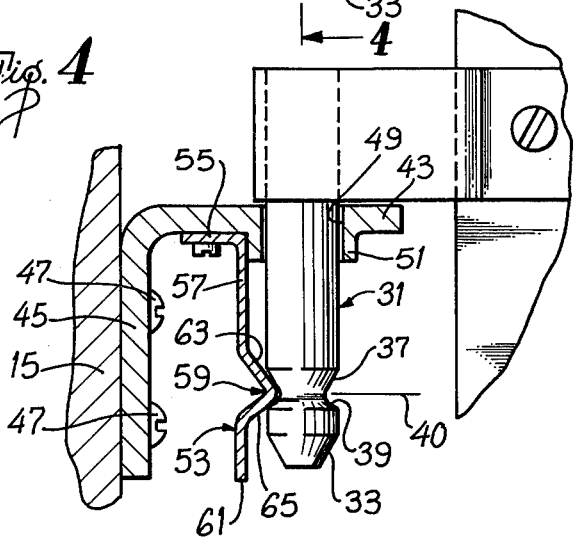
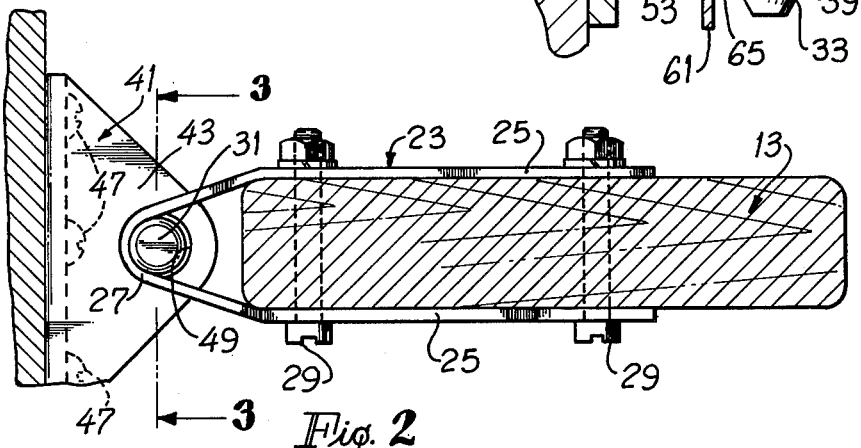
Fig. 2

RELEASABLE RUDDER LOCK

BACKGROUND OF THE INVENTION

One prior art mechanism for mounting a rudder on a boat includes first and second brackets attached to the rudder and first and second pintles mounted on the first and second brackets, respectively. Two apertured gudgeons or mounting members are mounted on the boat. The apertures are adapted to pivotally receive the pintles, respectively, thereby pivotally mounting the rudder.

One problem with this prior art construction relates to the retention of the pintles in the apertures of the gudgeons. With the prior art device shown in U.S. Pat. No. 502,723, a pin mounted on the boat cooperates with a groove in the pintle to prevent unintentional withdrawal of the pintle. The pin projects through an opening in the back of the boat.

With this prior art construction, it is difficult to properly align the various elements of the rudder lock such as the pin and the groove. Removal or demounting of the rudder is made difficult in that the pin can only be withdrawn by someone who is in the boat. It is also undesirable to have the opening in the boat which is necessary for pin mounting purposes. Finally, this prior art construction is relatively expensive.

The rudder lock disclosed in my U.S. Pat. No. 3,854,434 overcomes these disadvantages by providing a resilient lock element which is carried by the pintle and which cooperates with the gudgeon to releasably retain the rudder on the boat. The pintle has an axially extending slot in which the resilient lock element is mounted. Although this resilient lock element is very satisfactory, it would be desirable to further simplify manufacturing and to further reduce the cost of the unit.

Another problem occurs when the rudder strikes a relatively immovable underwater object. This can cause damage to the rudder and other parts of the boat as well as inconvenience to the passengers of the boat.

SUMMARY OF THE INVENTION

The present invention provides a rudder lock which is of simple and inexpensive construction. This is accomplished by carrying the resilient lock element on the gudgeon and by providing cooperating surface means on the resilient lock element and the pintle for retaining the pintle against withdrawal from the aperture of the gudgeon. By providing the resilient lock element on the gudegeon, the slot in the pintle, which was required in my patented device, is eliminated. In addition, the resilient lock element can be longer than if it is carried in a slot in the pintle. This increased length provides added mechanical advantage to facilitate release of the rudder lock. Finally, the fully exposed resilient lock element is readily manually releasable from both sides of the rudder, and its function is more apparent to the user.

The rudder lock of this invention also provides for automatic release of the rudder if the rudder strikes a relatively immovable underwater object. This is accomplished by providing the rudder lock with means responsive to a force of at least a first magnitude acting on the pintle in a predetermined direction for releasing the rudder lock to allow withdrawal of the pintle from the aperture.

The automatic release feature can be embodied in various different rudder locks. However, it is particularly adapted for incorporation into a rudder lock in which the resilient lock element is carried by the gudgeon. Preferably the cooperating surface means of the resilient lock element and the pintle are appropriately shaped so that the resilient lock element is cammed radially outwardly to a releasing position in response to a predetermined upward load on the rudder. In other words, the cooperating surface means includes cam means responsive to an upward force on the rudder of at least a first magnitude for moving the resilient lock element radially outwardly to a releasing position.

To install the rudder on the boat, the pintle is inserted through the aperture of the gudgeon. The resilient lock element and the pintle cooperate to automatically retain the pintle against withdrawal from the aperture of the gudgeon. This can be advantageously accomplished by providing cooperating cam surfaces on one or both of the pintle and the resilient lock element. These cam surfaces cam the resilient lock element radially outwardly during insertion of the pintle through the aperture. The resilient lock element has a projection and the pintle has a recess, and when the pintle is fully inserted, the projection snaps into the recess to hold the pintle against withdrawal.

The mounting member preferably includes a first leg portion adapted to project outwardly of the boat. The aperture is in the first leg portion, and the resilient lock element is attached to the first leg portion.

The invention, together with further features and advantages thereof, may best be understood by reference to the following description taken in connection with the accompanying illustrative drawing.

BRIEF DESCRIPTION OF THE DRAWING

FIG. 1 is a fragmentary side elevational view of a boat and rudder.

FIG. 2 is an enlarged fragmentary sectional view taken generally along line 2—2 of FIG. 1.

FIG. 3 is a fragmentary sectional view taken generally along line 3—3 of FIG. 2.

FIG. 4 is a fragmentary sectional view taken generally along line 4—4 of FIG. 3.

DESCRIPTION OF THE PREFERRED EMBODIMENT

FIG. 1 shows a boat 11 having a rudder 13 pivotally mounted on a back wall 15 of the boat at the aft end thereof. The rudder 13 can be pivoted by a tiller 17 which is suitably pivotally attached to the upper end of the rudder. The boat 11 and the rudder 13 may be of various different constructions, and the construction shown in FIG. 1 is purely illustrative.

The rudder 13 is mounted on the backwall 15 by mounting units 19 and 21. Except as expressly noted herein, the mounting units 19 and 21 may be identical. The mounting unit 19 includes a bracket 23 of generally U-shaped configuration in plan (FIG. 2). The bracket 23 may be constructed of a single metal strap bent into an appropriate configuraion. In the embodiment illustrated, the bracket 23 includes a pair of legs 25 integrally joined by a connecting portion 27. The bracket 23 receives a portion of the rudder 13 as shown in FIG. 2 and is attached to the rudder in any suitable way such as by threaded fasteners 29.

A pintle 31 is mounted on the connecting portion 27 of the bracket 23 in any suitable manner such as by welding. In the embodiment illustrated, the pintle 31 is in the form of a metal pin or shaft having a tapered or conical lower end or nose 33 and an annular recess 35. Although the recess 35 may be defined in various different ways, in the embodiment illustrated, the pintle 31 has tapered or conical cam surfaces 37 and 39 which substantially define the recess 35. The cam surfaces 37 and 39 are coaxial and taper radially inwardly as they extend toward each other. The cam surfaces 37 and 39 may intersect or may be separated by a cylindrical or other surface region of the pintle 31. In the embodiment illustrated, the cam surface 39 tapers radially inwardly at a much steeper angle than the cam surface 37. By way of example and not by way of limitation, the cam surfaces 37 and 39 may form angles of 60° and 30°, respectively, with reference to a reference line 40 (FIG. 4) which extends radially relative to the pintle 31. As explained more fully hereinbelow, the angles of the cam surfaces 37 and 39 can be varied depending upon the results desired.

The mounting unit 19 also includes a mounting member in the form of a gudgeon 41. The gudgeon 41, in the embodiment illustrated, is a metal bracket having perpendicular legs 43 and 45. The leg 45 is suitably attached as by screws 47 to the back wall 15. The leg 43 has an aperture 49 therein sized to receive the pintle 31. A boss or collar 51 is formed integrally with the leg 43 and projects downwardly to define an extension of the aperture 49. As used herein, the term "mounting member" is not limited to the gudgeon 41 but include any suitable structure associated with the boat for pivotally mounting the pintle 31.

A resilient lock element 53 is carried by the gudgeon 41. Specifically, the resilient lock element 53 has an attaching flange 55 which is attached to the leg 43 in any suitable manner such as by spot welding, or riveting threaded fasteners.

The resilient lock element is an elongated, integral, one-piece unit constructed of a suitable resilient material such as metal. The resilient lock element 53 includes an arm which projects from the leg 43 along a portion of the pintle, i.e. it generally extends axially of the pintle 31 and which engages and is supported by the boxx 51 inboard of the aperture 49. The arm of the resilient lock 53 includes an inner portion 57, a projection 59, and an end portion or tab 61. The projection 59 has inclined cam surfaces 63 and 65 which intersect to give the projection 59 a generally V-shaped configuration in cross-section. The cam surfaces 63 and 65 extend radially toward the pintle 31 as they extend axially toward each other. The slopes of the cam surfaces 63 and 65 may generally equal the slopes of the nose 33 and the cam surface 39, respectively.

Portions of the mounting unit 21 corresponding to portions of the mounting unit 19 are designated by corresponding reference numerals followed by the letter *a*. The mounting unit 21 is identical to the mounting unit 19 except that the length of the pintle 31*a* projecting downwardly from the bracket 23*a* is less than the length of the pintle 31 projecting downwardly from the bracket 23. In addition, the mounting unit 21 does not have a resilient lock element 53 and the pintle 31*a* does not have a recess 35.

To install the rudder 13 on the boat 11, the rudder is appropriately supported and the pintles 31 and 31*a* are aligned with the apertures in the gudgeons 41 and 41*a*, respectively. The simultaneous alignment of the pintles 31 and 31*a* with the apertures of the gudgeons 41 and 41*a* is facilitated by the relatively short distance that the pintle 31*a* projects from beneath its bracket 23*a*.

With this alignment maintained, the rudder 13 is moved downwardly and the tapered nose 33 of the pintle 31 guides the pintle 31 into the aperture 49 of the gudgeon 41. As this downward movement of the rudder 13 and the pintles 31 and 31*a* progresses, the tapered nose 33 engages the cam surface 63 of the resilient lock element 53. Further downward movement of the pintle 31 causes the tapered nose 33 to cooperate with the cam surface 63 to cam the resilient lock element 53 radially outwardly away from the pintle. As the flange 55 of the resilient lock element 53 is affixed to the leg 43 of the gudgeon 41, this radial outward movement of the resilient lock element is accomplished by resiliently bending the portion of the resilient lock element which depends from the leg 43.

The downward movement of the pintles 31 and 31*a* continues until the brackets 23 and 23*a* come to rest on the gudgeons 41 and 41*a*, respectively. In this position, the projection 59 is received in the bottom of the recess 35 to define a locking position of the resilient lock element 53. In other words, the projection 59 rides over the pintle 31 and resiliently snaps into the groove 35. The resilience of the resilient lock element 53 maintains the projection 59 in the recess 35. In this manner, the resilient lock element 53 cooperates with the pintle 31 to automatically restrain the pintle against removal from the aperture 49 in response to insertion of the pintle a predetermined distance into the aperture. The slopes of the cam surfaces 37 and 39 of the recess 35 are at least equal to the slopes of the cam surfaces 63 and 65, respectively, so that the recess can fully receive the projection.

If the rudder 13 should strike a relatively immovable underwater object, an upward force is applied to the pintles 31 and 31*a*. The pintle 31*a*, in the embodiment illustrated, is not retained in the gudgeon 41*a* other than by the weight of the rudder assembly and the resilient lock 53. An upward force on the pintle 31 causes the cam surface 39 to bear against and cooperate with the cam surface 65 to urge the resilient lock element 53 radially outwardly toward a releasing position. The angles of the cam surfaces 39 and 65 and the resilience of the resilient lock element may be selected so that a force of a predetermined magnitude on the pintle will disengage the recess 35 from the projection 59. In this manner, the rudder 13 can "pop out" of its mounting in response to a force of lesser magnitude than would cause damage to the rudder.

To manually remove the rudder 13 from the boat 11, the end portion 61 of the resilient lock element 53 is manually pushed toward the back wall 15, i.e. radially outwardly of the pintle 31 to a releasing position in which the projection 59 is out of the recess 35. The resilient lock element 53, being a single piece of formed metal is very easy to make. The resilient lock element 53 can also be very easily attached to the gudgeon 41 by welding. Similarly, the recess 35 is easy to make. The operation of the resilient lock element 53 is readily apparent to the user, and it can be released from either side of the rudder 13. The length of the resilient lock element 53 can be selected to provide the amount of mechanical advantage desired for manually releasing the rudder.

Although an exemplary embodiment of this invention has been shown and described, many changes, modifications and substitutions may be made by one with ordinary skill in the art without necessarily departing from the spirit and scope of this invention.

I claim:

1. An apparatus for pivotally mounting a rudder on a boat, said apparatus comprising:

a bracket attachable to the rudder;

a pintle;

means for attaching the pintle to the bracket with at least a portion of the pintle projecting away from the bracket;

a mounting member attachable to the boat and having an aperture sized to receive the pintle, said pintle being insertable in said aperture to at least assist in mounting the rudder for pivotal movement relative to the boat;

a resilient lock element carried by said mounting member and engageable with said pintle when the pintle is received in said aperture;

cooperating surface means on said resilient lock element and said pintle for retaining the pintle against withdrawal from the aperture of the mounting member, said resilient lock element being resiliently movable to allow withdrawal of the pintle from the aperture; and said mounting member having a collar at least partly defining said aperture and said resilient lock element having an attaching flange and a resilient arm, said attaching flange being attached to the mounting member and a portion of said arm being closely adjacent said collar, and said arm and said collar extending from said mounting member in the same general direction.

2. An apparatus as defined in claim 1 wherein said mounting member includes a first leg portion adapted to project outwardly of the boat, said aperture being in said first leg portion, said arm of said resilient lock element projecting from said first leg portion along at least a portion of said pintle.

3. An apparatus as defined in claim 2 wherein said attaching flange of said resilient lock element is attached to said first leg portion and said cooperating surface means are remote from said first leg portion and includes first and second cooperating surfaces on the arm and pintle, respectively, whereby at least the portion of said arm between the cooperating surface of the arm and the attaching flange can be resiliently deflected to allow withdrawal of the pintle from the aperture.

4. An apparatus as defined in claim 1 wherein said cooperating surface means includes cam means responsive to a force of at least a first magnitude acting on said pintle in a direction tending to withdraw the pintle from the aperture for releasing said resilient lock element to allow withdrawal of the pintle from the aperture.

5. An apparatus as defined in claim 1 wherein said resilient arm extends along a region of the pintle when the pintle is in the aperture, said cooperating surface means includes a cooperating surface on said arm and a cooperating surface on said pintle, said cooperating surface on said arm forming a projection on said arm and said cooperating surface on said pintle forming a recess in said pintle, said projection being receivable in said recess to retain the pintle against withdrawal from the aperture.

6. An apparatus as defined in claim 5 wherein the projection and the recess have sloping sides and said recess is annular.

7. An apparatus as defined in claim 5 wherein said cooperating surfaces include cam means responsive to a force of at least a first magnitude acting on said pintle in a direction tending to withdraw the pintle from the aperture for releasing said resilient lock element to allow withdrawal of the pintle from the aperture.

8. In combination:

a boat having a first mounting member with an aperture therein;

a rudder;

a pintle;

means for attaching said pintle to the rudder, at least a portion of said pintle being receivable in the aperture of the first mounting member to at least assist in mounting the rudder for pivotal movement relative to the boat;

releasable locking means on said pintle and said first mounting member responsive to the insertion of said portion of said pintle a predetermined distance into said aperture for restraining said portion of the pintle against removal from the aperture;

said releasable locking means including an integral resilient lock element carried by said first mounting member and deformable radially from a first position in which it restrains the pintle against removal from the aperture and a second position in which it allows insertion of the pintle into, and removal of the pintle from, the aperture; and said mounting member having a collar at least partly defining said aperture and said releasable locking means having an attaching flange and a resilient arm, said attaching flange being attached to the mounting member and a portion of said arm being closely adjacent said collar, and said arm and said collar extending from said mounting member in the same general direction.

* * * * *